US005424485A

United States Patent [19]

Hsu et al.

[11] Patent Number: 5,424,485

[45] Date of Patent: Jun. 13, 1995

[54] MOTION GENERATING MECHANISM FOR A MUSIC BOX

[76] Inventors: Feng H. Hsu, 7th Fl., No.9, Lane 100, Ho Chiang Street; Ching-fa Huang, 5th Fl., No. 7-1, Alley 56, Lane 166, Shin Pai Rd. Set 1, both of Taipei, Taiwan, Prov. of China

[21] Appl. No.: 185,018

[22] Filed: Jan. 24, 1994

[51] Int. Cl.[6] ..... G10F 1/06

[52] U.S. Cl. ..... 84/95.1; 446/298; 446/303; 40/455; 40/411

[58] Field of Search ..... 84/95.1, 95.2, 94.1, 84/94.2; D17/24; 446/303, 302, 299, 298; 40/411, 414, 455

[56] References Cited

U.S. PATENT DOCUMENTS 2,840,949 7/1958 Faulkner ..... 84/95.2

5,226,845 7/1993 Wu ..... 446/303

*Primary Examiner*—M. L. Gellner

*Assistant Examiner*—Cassandra C. Spyrou

*Attorney, Agent, or Firm*—Browdy and Neimark

[57] ABSTRACT

A motion generating mechanism particularly adapted for use in a music box is equipped with a vertical rod which can be actuated to swing back and forth and a pair of follower rods which are driven to rotate and repeatedly move up and down simultaneously. A shaft having one end engaged with the spring actuated rolling wheel of a music box is provided with an elliptic cam plate at each end thereof; and the bottom end of the follower rods having an abutment plate in contact with the elliptic cam plate are urged to move up and down and circularly. A rotation arm driven by the rolling wheel by way of a gear member and engaged with a swing follower having the vertical rod secured at one end is used to produce a pivotal swing motion of the vertical rod. Each abutment plate is provided with a recess which can be selectively engaged with a stop rod so as to restrain the follower rod from spinning and limit to move up and down only.

4 Claims, 4 Drawing Sheets

MOTION GENERATING MECHANISM FOR A MUSIC BOX

BACKGROUND OF THE INVENTION

The present invention relates to a motion generating mechanism particularly adapted for use in a music box. Powered by a spring actuated rolling wheel which is engaged with a shaft having an elliptic cam plate at each end thereof, and engaged, by means of a gear member, with a rotation arm which is further associated with a pivotal swing follower having a vertical rod secured at one end thereof. Each elliptic cam plate is in abutment with the bottom end of a follower rod movably limited in place in a cap. Thus, the vertical rod and the follower rods are able to pivotally swing and repeatedly move up and down and spin respectively, making the articles attached at the rods to move in a versatile manner.

Most conventional music boxes can produce only simple motion in syncronism with music playing, and no complicated mechanical operation can be created.

SUMMARY OF THE INVENTION

Therefore, the primary object of the present invention is to provide a motion generating mechanism for use in a music box which can produce a repeated pivotal swing motion by way of a rotation arm and a swing follower wherein the rotation arm is engaged with the spring actuated rolling wheel of the music box.

Another object of the present invention is to provide a motion generating mechanism which is provided with a shaft having an elliptic cam plate at each end and engaged with the spring actuated rolling wheel of the music box, the cam plates are in engagement with two follower rods each having an abutment plate disposed at the bottom end thereof so that the follower rods are driven to move up and down and circularly simultaneously.

One further object of the present invention is to provide a motion generating mechanism wherein the abutment plates of the follower rods are provided with a recess respectively in which a stop rod having one end secured to a plate fixed to the follower rod can be disposed so as to restrain the follower rod from spinning but to move up and down vertically.

DETAILED DESCRIPTION OF THE PREFERRED EMBODIMENT

Figure 1:
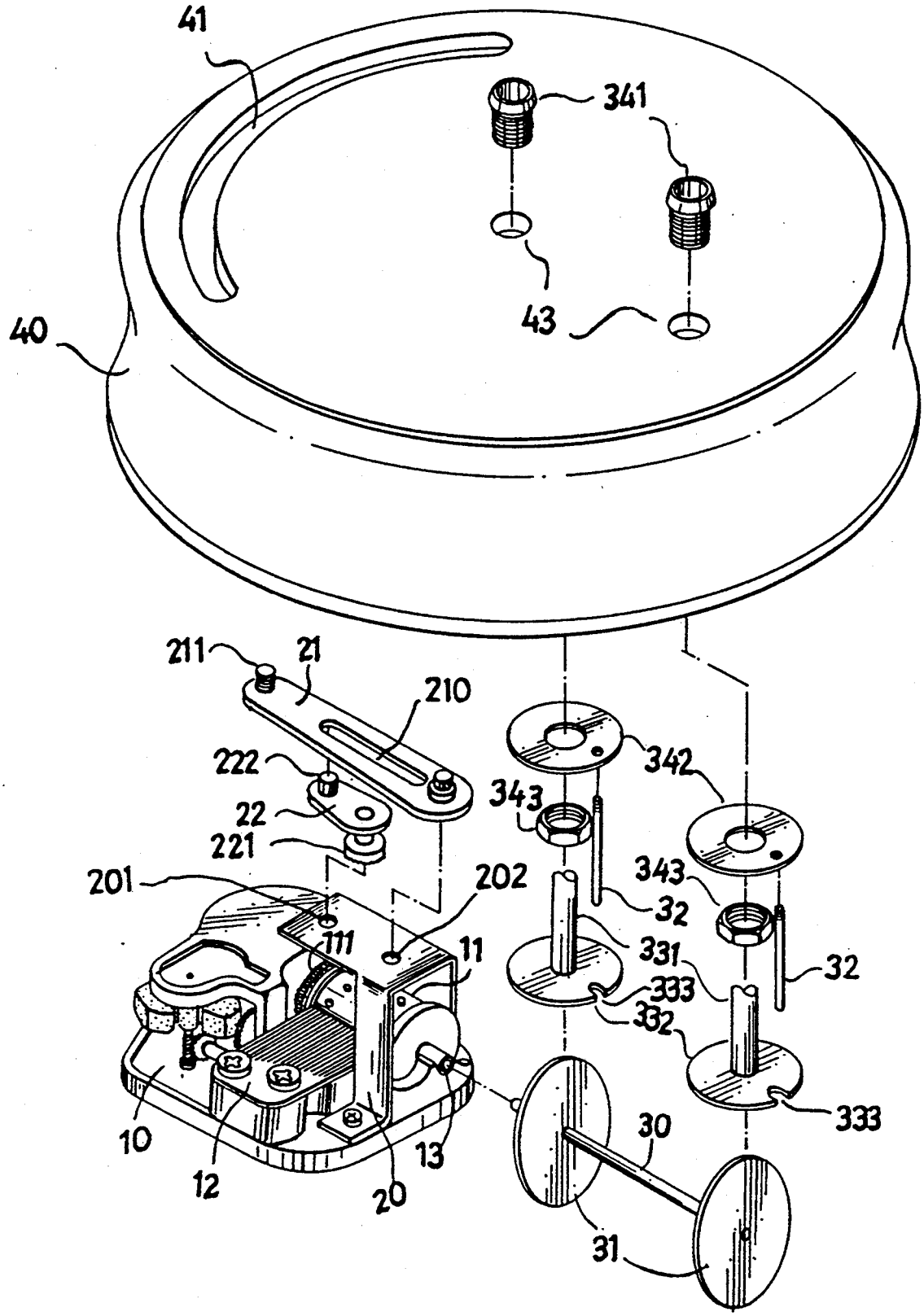
FIG. 1 is a perspective diagram showing the exploded components of the present invention.

Referring to FIG. 1, the music box motion generating mechanism of the present invention is comprised of a main entity, a swing assembly and a motion generating assembly.

The main entity includes a mount 10, a rolling wheel 11 having a gear 111 disposed at one end thereof and a shaft engaging sleeve 13 at the other end, and a music playing rods assembly 12. On the rolling wheel 11 are disposed a plurality of protruding spots which are selectively engaged with and moved against the tips of the rods of the music playing rods assembly 12 continuously as the rolling wheel 11 is being rotated whereby music can be produced as a result of the vibration of the rods separately.

The swing assembly is made up of a supporting bracket 20, a rotation arm 22 and a swing follower 21. The supporting bracket 20 is fixed to the mount 10 just above the rolling wheel 11. To the flat top and at the left end of the supporting bracket 20 is rotatably secured the rotation arm 22, and a gear member 221 is fixed coaxially with respect to the pivot axis of the rotation arm but on the other side of the supporting bracket 20 so as to be engaged with the gear 111 at one end of the rolling wheel 11.

At the right end of the flat top of the supporting bracket 20 is pivotally disposed the swing follower 21 having an elongated slot 210 in which a projected spot 222 disposed at one end of the rotation arm 22 is slidably restrained. Both the rotation arm 22 and the swing follower 21 are piovtable and rotatable with respect to the supporting bracket 20 at the fixing hole 201 and fixing hole 202.

The motion generating assembly includes a shaft 30 having at each end an elliptic cam plate 31; a pair of follower rods 331 with each of which each cam plate 31 is engaged; round abutment plates 332 each having a recess 333 disposed thereon; stop rods 32; and hollow bolts 341 and nuts 343.

Figure 2:
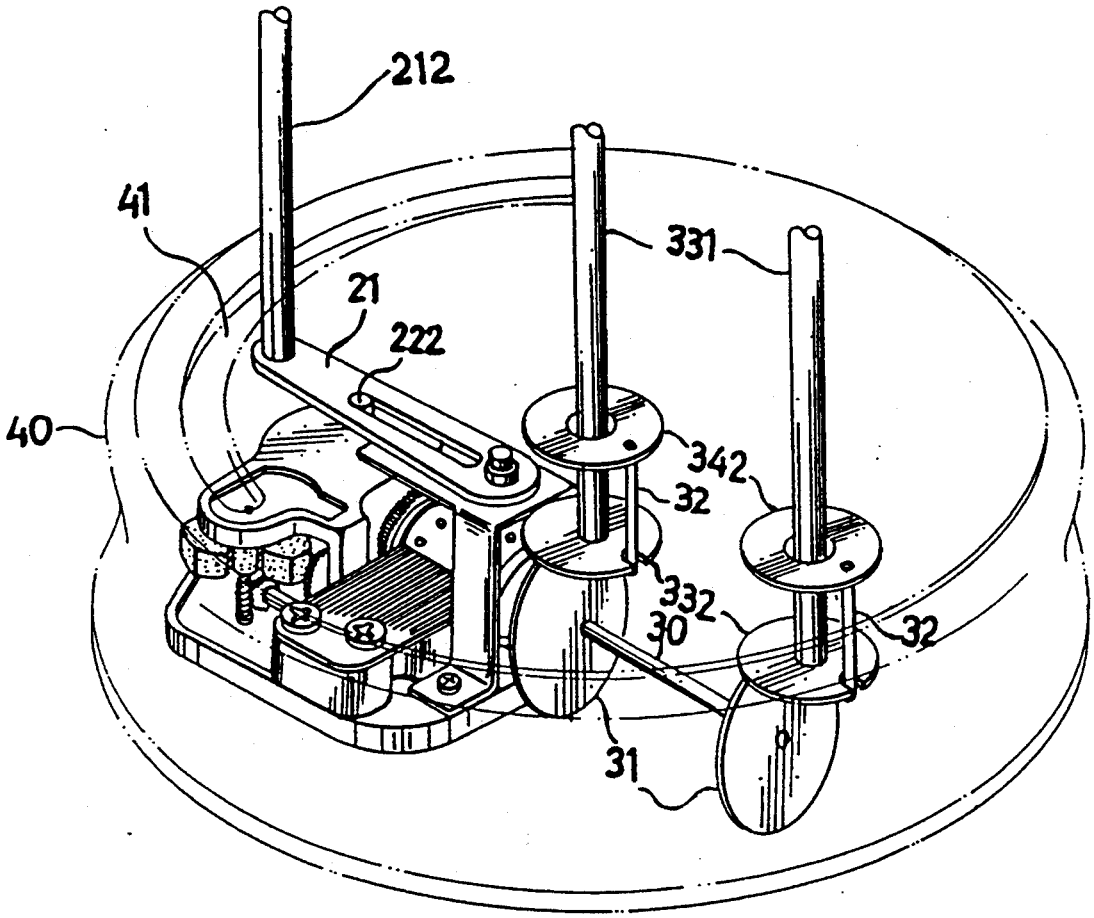
FIG. 2 is a perspective diagram showing the operational assembly thereof.
Figure 3:
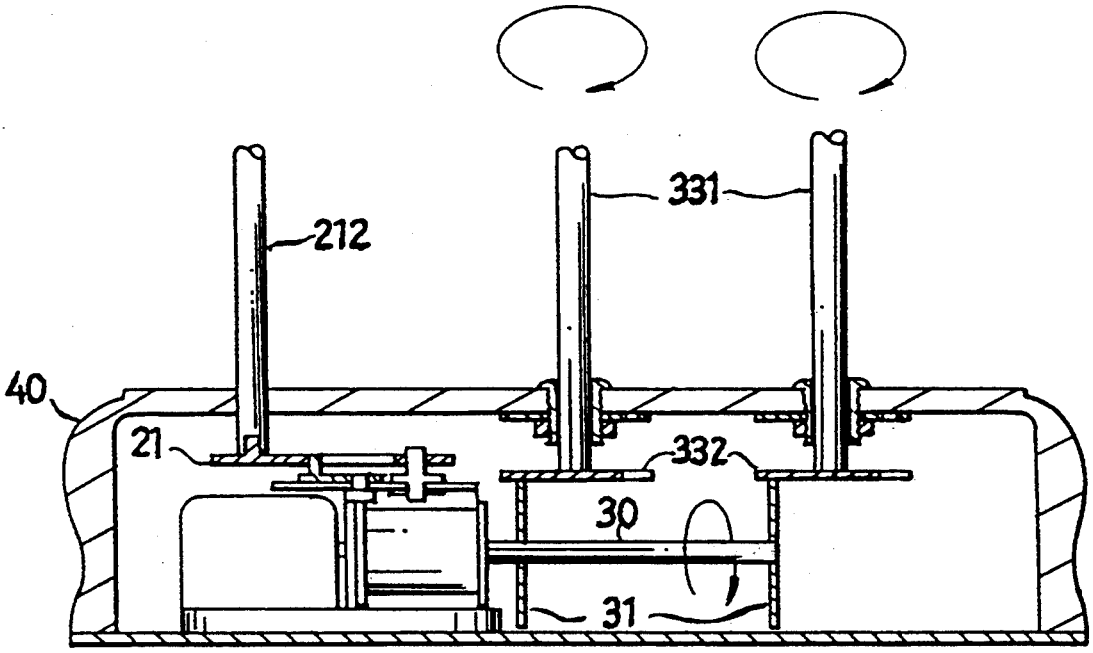
FIG. 3 is a sectional view thereof showing the operation of motion generating mechanism without the stop rods.

With the shaft engaging sleeve 13 of the rolling wheel 11 is engaged one of the protruded end of the shaft 30 to each end of which is respectively fixed an elliptic cam plate 31 so that the shaft 30 can be driven along with the rolling wheel. Each of the follower rods 331 is led through a hole 43 disposed at the top of a cap 40 and slidably fixed in place by means of the hollow bolt 341 and the nut 343 with a plate 342 restrained therebetween as shown in FIGS. 2, 3.

To the bottom of each follower rod 331 is secured one of the abutment plates 332 which is in contact with the elliptic cam plate 31 whereby the rotation of the shaft 30 driven by the rolling wheel 11 will cause the follower rods 331 to move up and down and circularly repeatedly by the cam plate 31.

Figure 4:
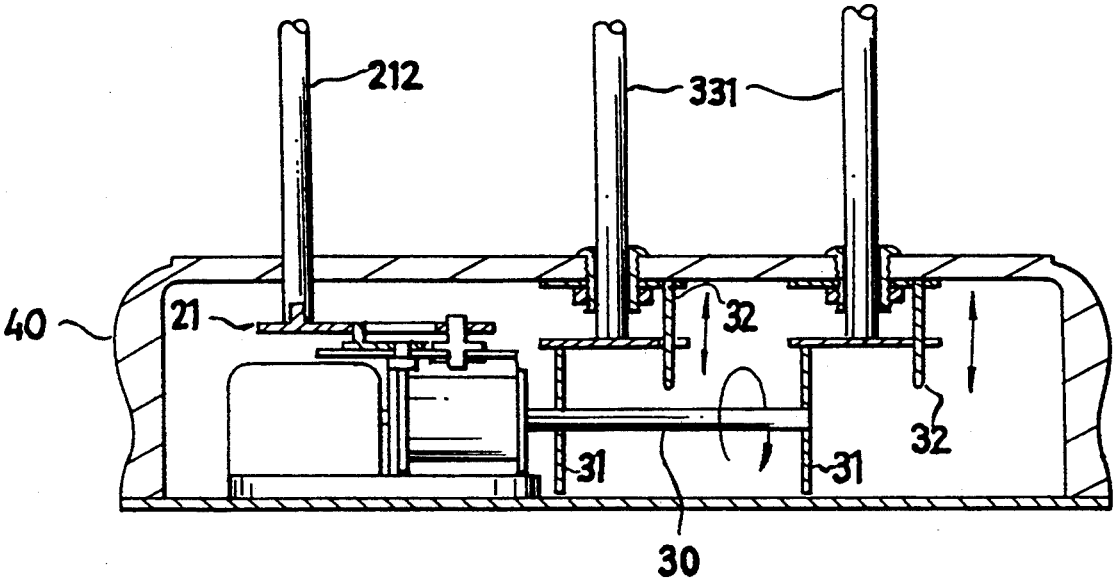
FIG. 4 is another sectional view thereof showing the operation of the motion generating mechanism with the stop rods.

The stop rod 32 having one end engaged with the plate 342 can be disposed in the recess 333 so as to restrain each abutment plate 332 and the follower rod 331 from rotation, and permit each follower rod only to move up and down, as shown in FIG. 4.

As the rolling wheel 11 is driven to rotate with the protruding spots moving against the tips of the music playing rods assembly 12 to produce music, the gear member 221 engaged with the gear 111 disposed at one end of the rolling wheel 11 is driven simultaneously to get the rotation arm 22 to rotate. The projected spot 222 of the rotation arm 22 is engaged with the elongated slot 210 of the swing follower 21 whereby the rotation of the rotation arm results in the pivotal swing of the swing follower 21 about the rightmost end fixed to the supporting bracket 20.

The swing follower 21 having a threaded fixing spot 211 disposed at the left end thereof is engaged with a vertical rod 212, as showing in FIGS. 2, 3, 4,. The vertical rod 212 is movably disposed in a curved guide slot 41 on the cap 40 so as to permit the same to be pivotally actuated back and forth along with the swing follower 21.

It can be clearly seen by way of the proceeding description that the rotation of the rolling wheel 11 causes the shaft 30 and the rotation arm 22 to operate at the same time by way of the engaging sleeve 13 and the gear member 221, resulting in the rotational and up-and-down movement of the follower rods 331 actuated by the elliptic cam plates 31 secured to the ends of the shaft 30, as well as the swing motion of the vertical rod 212 fixed to and driven by the swing follower 21 which is actuated by the rotation arm 22.

I claim:

1. A motion generating mechanism adapted for use in a music box, comprising:

a spring actuated rolling wheel having a first gear disposed at one end thereof;

a music playing means in contacting engagement with said rolling wheel to produce music;

a mount on which said rolling wheel and said music playing means are secured;

a supporting bracket fixed to said mount just above said rolling wheel;

a rotation arm having a second gear corresponding to said first gear and a projected spot at a first end;

a second end of said rotation arm being rotatably mounted on said supporting bracket with said first gear in driving engagement with said second gear;

a swing follower having an elongated slot which is slidingly engaged with said projected spot at said first end of said rotation arm so as to permit said swing follower to swing back and forth along with the rotation of said rotation arm;

a first end of said swing follower being pivotally fixed on said supporting bracket;

a vertical rod secured to a second end of said swing follower;

a cap having a curved slot in which said vertical rod is inserted in sliding engagement to permit said vertical rod to swing back and forth within the curved slot;

a shaft having each end provided with a cam plate being associated and rotated together with said rolling wheel;

a pair of follower rods being in respective engagement with said cam plates;

an abutment plate disposed at a bottom end of each of said follower rods being in respective rotational contact with said cam plates so as to permit each of said follower rods to move up and down and rotate simultaneously together with the rotation of said shaft by way of each said cam plate;

said cap having a pair of through holes for the passing of said follower rods;

each of said follower rods being respectively led through one of said through holes and one of two hollow bolts and nuts engaged together on opposite sides of said cap so as to permit each od said follower rods to be movably secured to said cap;

whereby turning of said rolling wheel causes said vertical rod to swing back and forth and each of said follower rods to move up and down and circularly repeatedly simultaneously.

2. A motion generating mechanism as claimed in claim 1 wherein each said abutment plate has a recess so as to permit a stop rod, having one end secured to a plate which is fixed between each said hollow bolts and nuts, to be disposed therein to restrain each said abutment plate and each of said follower rods from rotation.

3. A motion generating mechanism as claimed in claim 1 wherein said cam plate is made in an elliptic shape.

4. A motion generating mechanism as claimed in claim 1 wherein at one end of said rolling wheel is disposed a shaft engaging sleeve so as to permit said shaft to be engaged with said rolling wheel and to be rotated together therewith.

* * * * *